US011795602B1

(12) United States Patent
Lee et al.

(10) Patent No.: US 11,795,602 B1
(45) Date of Patent: Oct. 24, 2023

(54) SHIPPING BOLT AND PACKAGING ASSEMBLY FOR A WASHING MACHINE APPLIANCE

(71) Applicant: Haier US Appliance Solutions, Inc., Wilmington, DE (US)

(72) Inventors: Jaebong Lee, Seoul (KR); Dong Soo Shin, Seoul (KR); Youn-Ki Min, Seoul (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/868,936

(22) Filed: Jul. 20, 2022

(51) Int. Cl.
*D06F 39/00* (2020.01)
*D06F 39/12* (2006.01)

(52) U.S. Cl.
CPC ..... *D06F 39/001* (2013.01); *D06F 39/12* (2013.01)

(58) Field of Classification Search
CPC ..... D06F 39/001; D06F 39/12; D06F 37/26; B65D 2585/6855; B65D 19/44; A47L 15/4268; A47L 15/427; F16B 21/09
USPC ..... 68/3 R
See application file for complete search history.

(56) References Cited

U.S. PATENT DOCUMENTS 2,442,844 A * 6/1948 Cooper ..... B65D 85/68 206/320
3,504,842 A * 4/1970 Grafslund ..... B65D 85/64 206/320
5,249,678 A * 10/1993 Traina ..... B65D 85/64 206/521
7,441,420 B2 10/2008 Kim et al.
8,425,165 B2 4/2013 Harada et al.
10,837,136 B2 11/2020 Rineer et al.
2003/0057342 A1* 3/2003 Johanson ..... D06F 39/001 248/346.02
2004/0118167 A1* 6/2004 Kim ..... D06F 39/001 68/3 R
2009/0074535 A1* 3/2009 Roberts ..... F16B 21/09 411/166
2011/0132799 A1* 6/2011 Lee ..... B65D 81/054 206/586

(Continued)

FOREIGN PATENT DOCUMENTS

CN 108611808 A 10/2018
CN 113089268 A 7/2021

(Continued)

*Primary Examiner* — David G Cormier
*Assistant Examiner* — Thomas Bucci
(74) *Attorney, Agent, or Firm* — Dority & Manning, P.A.

(57) ABSTRACT

A shipping assembly for a washing machine appliance includes a shipping box that defines a box aperture that is aligned with an aperture defined through a cabinet of the appliance when the appliance is positioned within the shipping box. A bolt assembly is configured for securing the wash tub within the cabinet when the bolt assembly is in an installed position, the bolt assembly including a spacer assembly that spaces apart the wash tub from the cabinet and the cabinet from the shipping box and that includes a retention flange to prevent the spacer assembly from falling into the shipping box. A shipping bolt includes a threaded shaft that passes through the spacer assembly to secure the spacer assembly to the wash tub and a bolt head that is seated against a shoulder of the spacer assembly in the installed position.

20 Claims, 4 Drawing Sheets

(56) References Cited

U.S. PATENT DOCUMENTS

| | | | | |
|---|---|---|---|---|
| 2012/0067253 | A1* | 3/2012 | Harada | B65D 19/0026 108/55.1 |
| 2013/0305789 | A1* | 11/2013 | Sul | D06F 37/264 68/139 |
| 2019/0038456 | A1 | 2/2019 | Chabel et al. | |
| 2019/0338456 | A1* | 11/2019 | Pacho Millán | F16B 21/09 |
| 2020/0199802 | A1* | 6/2020 | Rineer | B65D 85/68 |
| 2021/0198830 | A1 | 7/2021 | Chun | |

FOREIGN PATENT DOCUMENTS

| | | | |
|---|---|---|---|
| DE | 19629884 | B4 | 4/2006 |
| KR | 20060007264 | A | 1/2006 |
| KR | 20060062192 | A | 6/2006 |
| WO | WO2010051601 | A1 | 5/2010 |

* cited by examiner

SHIPPING BOLT AND PACKAGING ASSEMBLY FOR A WASHING MACHINE APPLIANCE

FIELD OF THE INVENTION

The present subject matter relates generally to laundry appliances, and more particularly to shipping assemblies for use in transporting washing machine appliances.

BACKGROUND OF THE INVENTION

Washing machine appliances generally include a cabinet that receives a tub for containing wash and rinse water. A wash basket is rotatably mounted within the tub. A drive assembly is coupled to the tub and configured to rotate the wash basket within the tub in order to cleanse articles within the wash basket. Upon completion of a wash cycle, a pump assembly can be used to rinse and drain soiled water to a draining system. Some washing machine appliances may also rotate the wash basket at a relatively high speed for a spin cycle to further drain or shed water from articles within the wash basket.

In general, the tub and the wash basket, sometimes referred to collectively as the subwasher, are movable relative to the cabinet of the washing machine appliance. For example, the subwasher is commonly suspended within the cabinet by one or more suspension devices. The suspension devices generally allow the tub to move relative to the cabinet during operation of the washing machine appliance. Notably, vibrations that may be experienced during the transportation of the washing machine appliance may overwhelm the suspension devices, resulting in premature wear or damage to one or more components of the appliance.

Accordingly, shipping bolts and spacers are commonly used to secure the tub or the subwasher to the cabinet to make the washer rigid and to ensure the safe handling of the washing machine appliance during shipping or other transport. After the washing machine appliance is installed, the shipping bolts and spacers should be removed prior to operating the machine. However, sometimes the shipping bolts and spacers are inadvertently left in the washer at the time of installation. If these bolts and spacers are not removed, the suspensions of the subwasher will not be activated and there will be a lot of noise and vibration. These issues result in customer dissatisfaction, damage to the appliance or surrounding property, and additional service visits or maintenance costs.

Accordingly, an improved system for securing the subwasher for transport of an appliance is desired. More specifically, a shipping assembly that enables safe transport of a washing machine appliance and increases the likelihood of proper removal/disassembly of the shipping assembly prior to appliance operation would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a shipping assembly for a washing machine appliance is provided. The washing machine appliance includes a cabinet defining a cabinet aperture and a wash tub suspended within the cabinet by a suspension assembly. The shipping assembly includes a shipping box defining a box aperture aligned with the cabinet aperture when the cabinet is positioned within the shipping box and a bolt assembly configured for securing the wash tub within the cabinet when the bolt assembly is in an installed position. The bolt assembly includes a spacer assembly including a cabinet spacer that extends between the wash tub and the cabinet and a box spacer that extends between the cabinet and the shipping box, wherein the box spacer has a first end defining a shoulder and a second end defining a retention flange that is seated against an outer surface of the shipping box to prevent the second end from passing into the shipping box, and a shipping bolt including a threaded shaft and a bolt head, wherein the threaded shaft passes through the box spacer and the cabinet spacer to secure the spacer assembly to the wash tub in the installed position, and wherein the bolt head is seated against the shoulder of the box spacer in the installed position.

In another exemplary embodiment, a packaged appliance is provided including a front load washing machine appliance including a cabinet defining a cabinet aperture and a wash tub suspended within the cabinet by a suspension assembly, a shipping box defining a box aperture aligned with the cabinet aperture when the cabinet is positioned within the shipping box, and a bolt assembly configured for securing the wash tub within the cabinet when the bolt assembly is in an installed position. The bolt assembly includes a spacer assembly includes a cabinet spacer that extends between the wash tub and the cabinet and a box spacer that extends between the cabinet and the shipping box, wherein the box spacer has a first end defining a shoulder and a second end defining a retention flange that is seated against an outer surface of the shipping box to prevent the second end from passing into the shipping box, and a shipping bolt includes a threaded shaft and a bolt head, wherein the threaded shaft passes through the box spacer and the cabinet spacer to secure the spacer assembly to the wash tub in the installed position, and wherein the bolt head is seated against the shoulder of the box spacer in the installed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
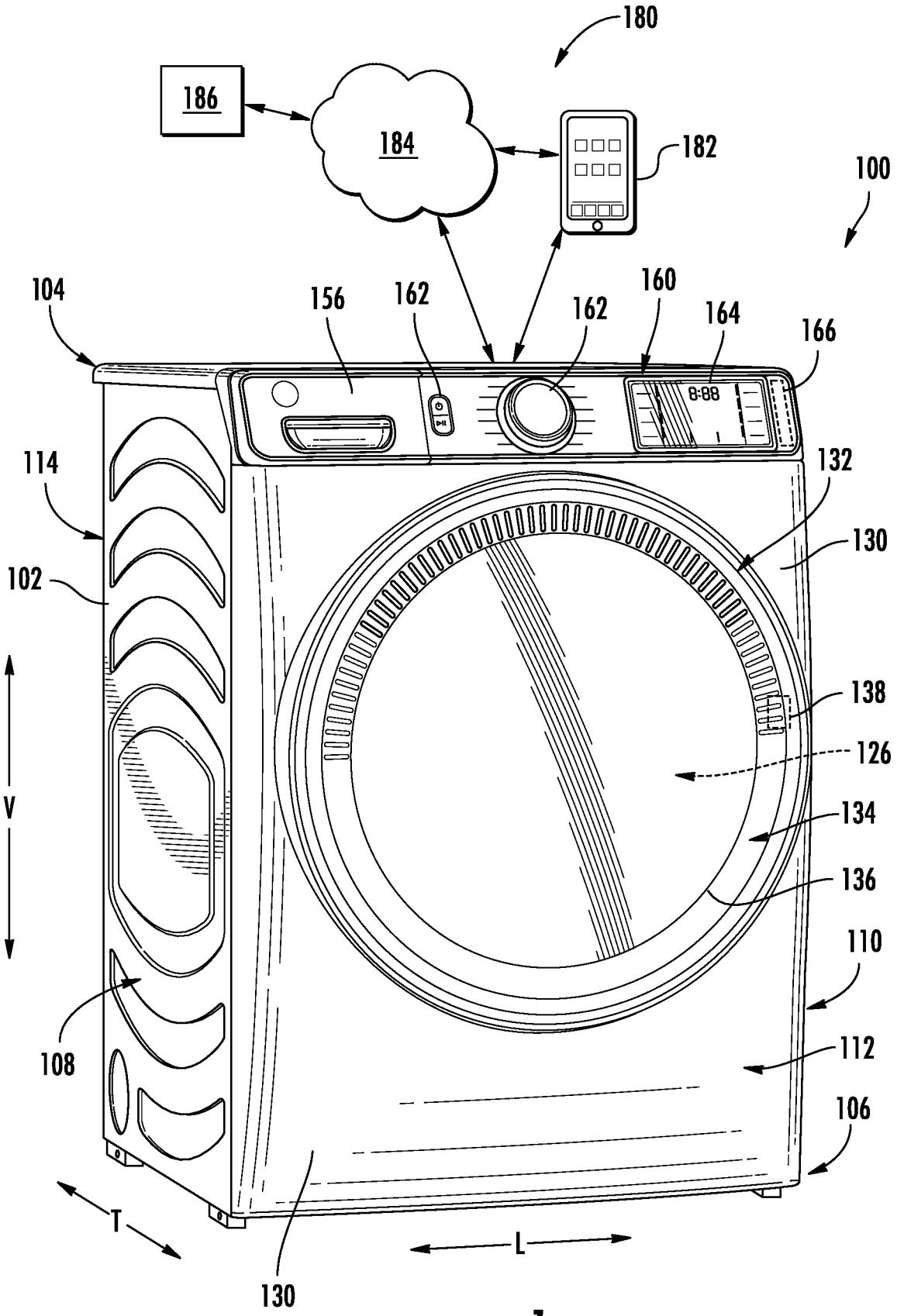
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
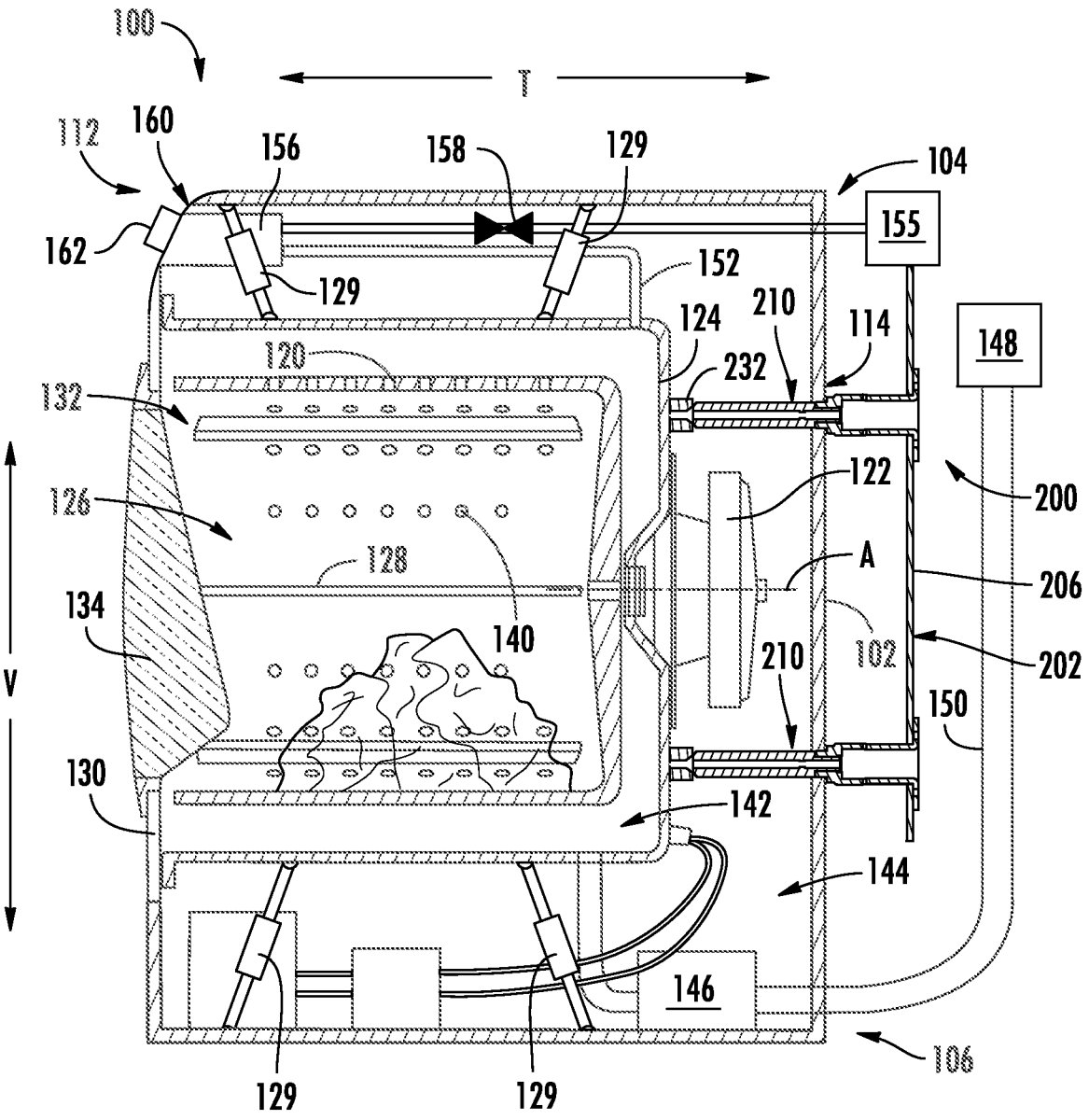
FIG. 2 provides a side cross-sectional view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined.

According to exemplary embodiments, washing machine appliance 100 includes a cabinet 102 that is generally configured for containing and/or supporting various components of washing machine appliance 100 and which may also define one or more internal chambers or compartments of washing machine appliance 100. In this regard, as used herein, the terms "cabinet," "housing," and the like are generally intended to refer to an outer frame or support structure for washing machine appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of washing machine appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along the vertical direction V, between a first side 108 (e.g., the left side when viewed from the front as in FIG. 1) and a second side 110 (e.g., the right side when viewed from the front as in FIG. 1) along the lateral direction L, and between a front 112 and a rear 114 along the transverse direction T. In general, terms such as "left," "right," "front," "rear," "top," or "bottom" are used with reference to the perspective of a user accessing washing machine appliance 100.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

According to exemplary embodiments, wash tub 124 may be generally suspended within cabinet 102 by one or more suspension assemblies 129, e.g., as shown for example in FIG. 2. In this regard, wash tub 124, wash basket 120, motor 122, and other components of washing machine appliance 100 may be referred to generally herein as the subwasher. In order to reduce the transmission of vibrations and other forces from the subwasher to the cabinet 102 during operation of washing machine appliance 100, wash tub 124 may be generally isolated from cabinet 102 by suspension assemblies 129. This may be desirable to prevent undesirable noise, vibrations, "walking" of the appliance, etc. It should be appreciated that suspension assemblies 129 may generally include any suitable number and combination of springs, dampers, or other energy absorbing mechanisms to reduce the transmission of forces between the subwasher and cabinet 102. Although exemplary suspensions assemblies 129 are illustrated herein, it should be appreciated that the number, type, and configuration of suspension assemblies 129 may vary while remaining within the scope of the present subject matter.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Washing machine appliance 100 may further include a latch assembly 138 (see FIG. 1) that is mounted to cabinet 102 and/or door 134 for selectively locking door 134 in the closed position and/or confirming that the door is in the closed position. Latch assembly 138 may be desirable, for example, to ensure only secured access to wash chamber 126 or to otherwise ensure and verify that door 134 is closed during certain operating cycles or events.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

Washing machine appliance 100 may further include a wash fluid dispenser that is generally configured for dispensing a flow of water, wash fluid, etc. into wash tub 124. For example, a spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

During operation of washing machine appliance 100, laundry items are loaded into wash basket 120 through opening 132, and washing operation is initiated through operator manipulation of one or more input selectors or using a remote device (see below). Wash tub 124 is filled with water, detergent, and/or other fluid additives, e.g., via spout 152 and/or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through opening 132.

Referring again to FIG. 1, washing machine appliance 100 may include a control panel 160 that may represent a general-purpose Input/Output ("GPIO") device or functional block for washing machine appliance 100. In some embodiments, control panel 160 may include or be in operative communication with one or more user input devices 162, such as one or more of a variety of digital, analog, electrical, mechanical, or electro-mechanical input devices including rotary dials, control knobs, push buttons, toggle switches, selector switches, and touch pads. Additionally, washing machine appliance 100 may include a display 164, such as a digital or analog display device generally configured to provide visual feedback regarding the operation of washing machine appliance 100. For example, display 164 may be provided on control panel 160 and may include one or more status lights, screens, or visible indicators. According to exemplary embodiments, user input devices 162 and display 164 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Washing machine appliance 100 may further include or be in operative communication with a processing device or a controller 166 that may be generally configured to facilitate appliance operation. In this regard, control panel 160, user input devices 162, and display 164 may be in communication with controller 166 such that controller 166 may receive control inputs from user input devices 162, may display information using display 164, and may otherwise regulate operation of washing machine appliance 100. For example, signals generated by controller 166 may operate washing machine appliance 100, including any or all system components, subsystems, or interconnected devices, in response to the position of user input devices 162 and other control commands. Control panel 160 and other components of washing machine appliance 100 may be in communication with controller 166 via, for example, one or more signal lines or shared communication busses. In this manner, Input/Output ("I/O") signals may be routed between controller 166 and various operational components of washing machine appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 166 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 166 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 166 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 166 as disclosed herein is capable of and may be operable to perform any methods, method steps, or portions of methods of appliance operation. For example, in some embodiments, these methods may be embodied in programming instructions stored in the memory and executed by controller 166.

The memory devices may also store data that can be retrieved, manipulated, created, or stored by the one or more processors or portions of controller 166. The data can include, for instance, data to facilitate performance of methods described herein. The data can be stored locally (e.g., on controller 166) in one or more databases and/or may be split up so that the data is stored in multiple locations. In addition, or alternatively, the one or more database(s) can be connected to controller 166 through any suitable network(s), such as through a high bandwidth local area network (LAN) or wide area network (WAN). In this regard, for example, controller 166 may further include a communication module or interface that may be used to communicate with one or more other component(s) of washing machine appliance 100, controller 166, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Referring again to FIG. 1, a schematic diagram of an external communication system 180 will be described according to an exemplary embodiment of the present subject matter. In general, external communication system 180 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 180 may be used to transfer data or other information to improve performance of one or more external devices or appliances and/or improve user interaction with such devices.

For example, external communication system 180 permits controller 166 of washing machine appliance 100 to communicate with a separate device external to washing machine appliance 100, referred to generally herein as an external device 182. As described in more detail below, these communications may be facilitated using a wired or wireless connection, such as via a network 184. In general, external device 182 may be any suitable device separate from washing machine appliance 100 that is configured to provide and/or receive communications, information, data, or commands from a user. In this regard, external device 182 may be, for example, a personal phone, a smartphone, a tablet, a laptop or personal computer, a wearable device, a smart home system, or another mobile or remote device.

In addition, a remote server 186 may be in communication with washing machine appliance 100 and/or external device 182 through network 184. In this regard, for example, remote server 186 may be a cloud-based server 186, and is thus located at a distant location, such as in a separate state, country, etc. According to an exemplary embodiment, external device 182 may communicate with a remote server 186 over network 184, such as the Internet, to transmit/receive data or information, provide user inputs, receive user notifications or instructions, interact with or control washing machine appliance 100, etc. In addition, external device 182 and remote server 186 may communicate with washing machine appliance 100 to communicate similar information.

In general, communication between washing machine appliance 100, external device 182, remote server 186, and/or other user devices or appliances may be carried using any type of wired or wireless connection and using any suitable type of communication network, non-limiting examples of which are provided below. For example, external device 182 may be in direct or indirect communication with washing machine appliance 100 through any suitable wired or wireless communication connections or interfaces, such as network 184. For example, network 184 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 180 is described herein according to an exemplary embodiment of the present subject matter. However, it should be appreciated that the exemplary functions and configurations of external communication system 180 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

As explained briefly above, during the shipment or transport of washing machine appliances, the subwasher (e.g., the wash tub and other suspended components) are typically secured to prevent excessive vibrations or damage resulting from such movement. For example, using washing machine appliance 100 as an example, the shipment process typically includes positioning one or more shipping bolts through cabinet 102 to engage and secure wash tub 124. Conventional shipping processes include installing such shipping bolts prior to positioning washing machine appliance 100 in a shipping box or transport. However, upon removing the appliance from the shipping box, installers frequently forget to remove the shipping bolts prior to installation. Notably, operating a washing machine with the shipping bolts in place can result in loud noises, appliance damage, and user dissatisfaction. Accordingly, aspects of the present subject matter are generally directed to systems and methods for ensuring that the shipping bolts are properly removed prior to operation of the washing machine.

Figure 3:
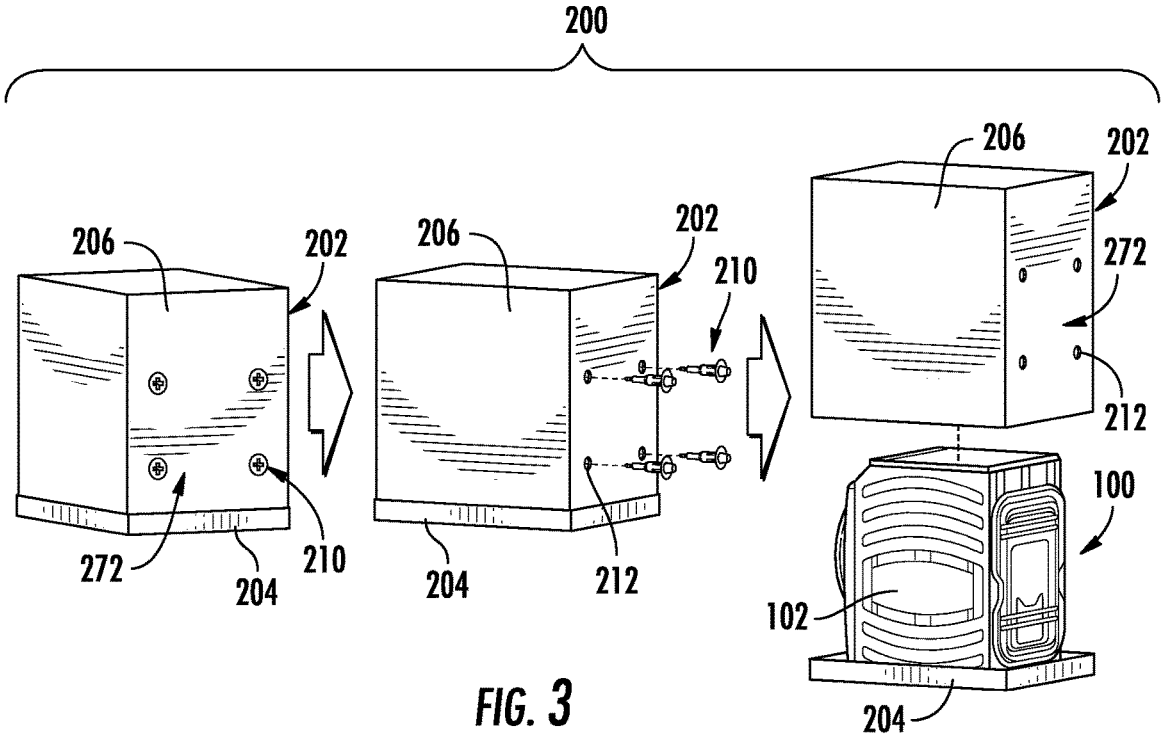
FIG. 3 provides a schematic view of a shipping assembly and a process for unpackaging a washing machine appliance in accordance with one embodiment of the present disclosure.

Referring now generally to FIGS. 2 through 6, an exemplary shipping assembly 200 that may be used to ship washing machine appliance 100 will be described according to exemplary embodiments of the present subject matter. For example, as best shown in FIG. 3, shipping assembly 200 generally includes a shipping box 202. More specifically, according to the illustrated embodiment, shipping box 202 may generally include a lower pallet 204 upon which washing machine appliance 100 may be seated and secured in any suitable manner. In addition, shipping box 202 may include an upper box 206 that is positioned over washing machine appliance 100 and is secured to lower pallet 204 to complete the packaged appliance assembly for transport to a consumer.

Referring still to FIG. 3, shipping assembly 200 may further include one or more bolt assemblies 210 that pass through shipping box 202 (e.g., through upper box 206) and into washing machine appliance 100 to secure the subwasher (e.g., via wash tub 124) within cabinet 102. Notably, by passing bolt assemblies 210 through shipping box 202 after the washing machine appliance 100 is inside shipping box 202 and by retaining a portion of bolt assemblies 210 on the outside of shipping box 202, shipping assembly 200 may motivate an installation technician to fully remove all bolt assemblies 210 prior to removing shipping box 202.

In this regard, to facilitate installation of washing machine appliance 100, the installation technician must access the water connection hoses, the power cord, and lower pallet 204 to remove washing machine appliance 100. Accordingly, to access these components, the installation technician would naturally be inclined to remove upper box 206. However, the installation technician would generally be prevented from doing so (e.g., outside of complete box destruction) until bolt assemblies 210 are removed (e.g., as illustrated schematically in FIG. 3). Accordingly, shipping assembly 200 generally provides a system for increasing the likelihood that the shipping bolt assemblies 210 are properly removed from washing machine appliance 100 before installation, thereby mitigating the likelihood of appliance damage and user dissatisfaction.

As best illustrated in FIGS. 3. 5 and 6, in order to facilitate insertion of bolt assemblies 210, shipping box 202 may generally define one or more box apertures 212 and cabinet 102 of washing machine appliance 100 may include one or more corresponding cabinet apertures 214. According to the illustrated embodiment, box aperture 212 may be generally aligned with cabinet aperture 214 when upper box 206 is positioned over washing machine appliance 100 in an installed position (e.g., as shown on the left in FIG. 3). According to the illustrated embodiment, cabinet apertures 214 are defined in a rear 114 of cabinet 102. In addition, the illustrated embodiment includes four box apertures 212, four cabinet apertures 214, and four bolt assemblies 210 to secure wash tub 124 within cabinet 102, though any other suitable number and positioning of apertures and bolt assemblies may be used while remaining within the scope of the present subject matter.

Figure 4:
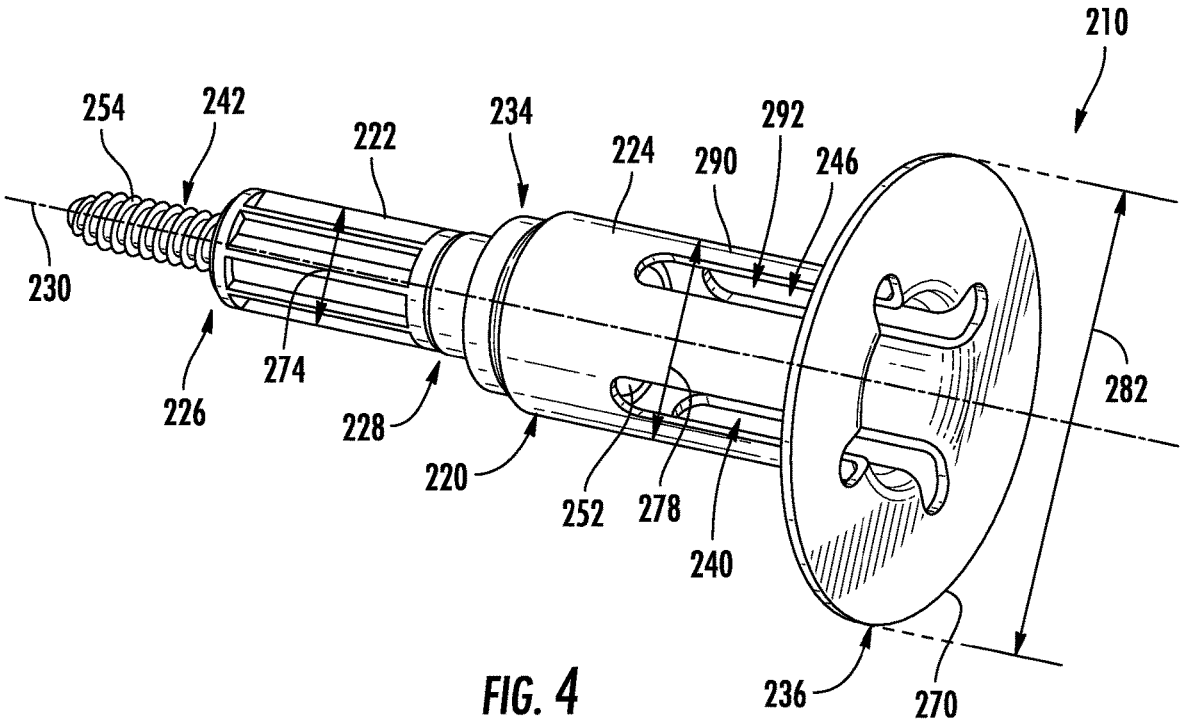
FIG. 4 provides a bolt assembly that may be used with the exemplary shipping assembly of FIG. 3 in accordance with one embodiment of the present disclosure.
Figure 5:
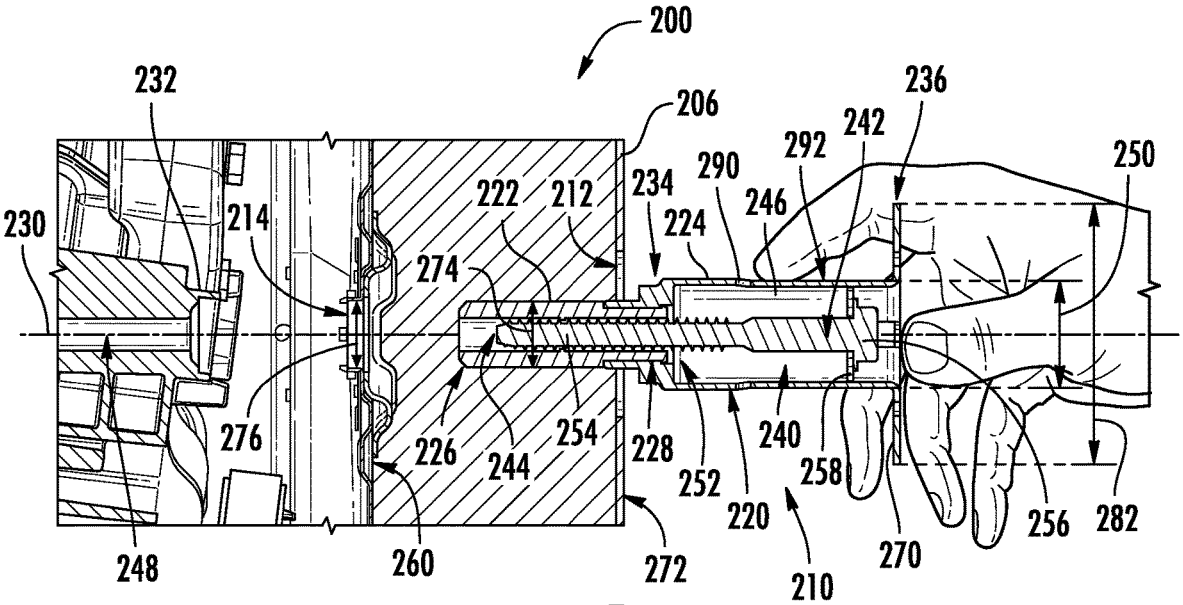
FIG. 5 illustrates the exemplary bolt assembly of FIG. 4 as it is being installed in accordance with one embodiment of the present disclosure.
Figure 6:
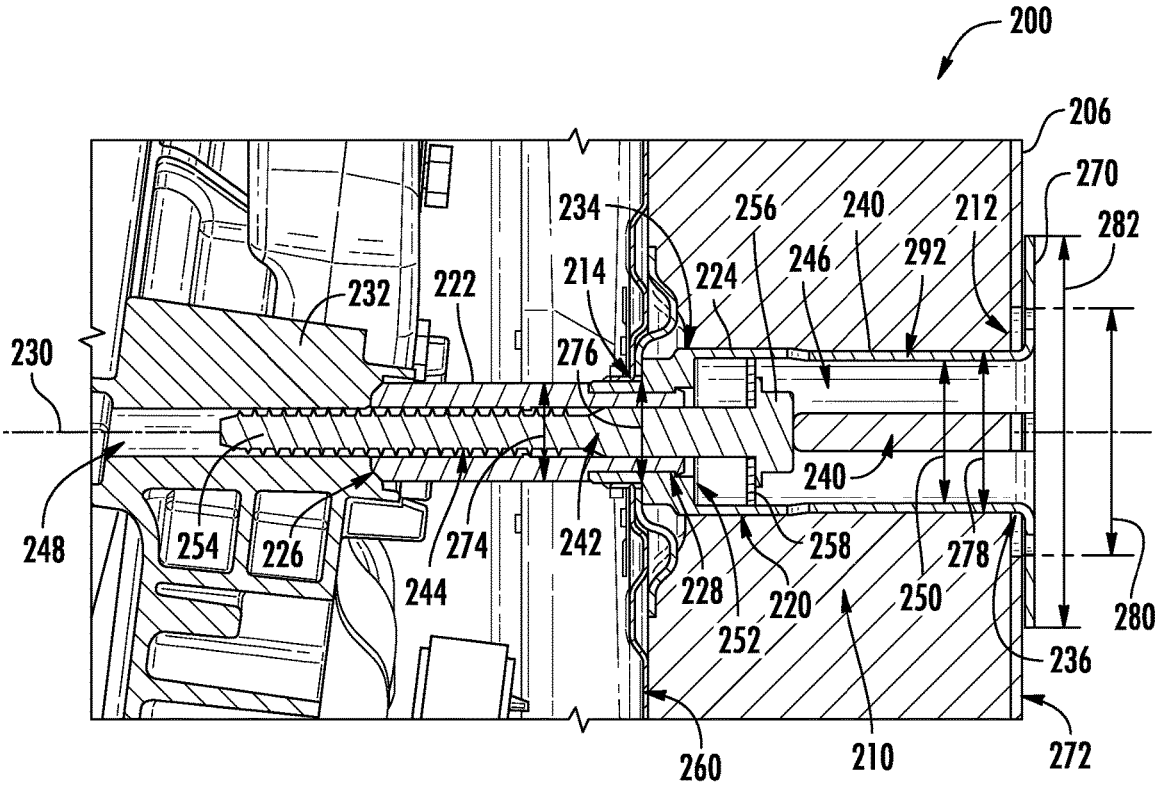
FIG. 6 illustrates the exemplary bolt assembly of FIG. 4 in an installed position in accordance with one embodiment of the present disclosure.

Referring now specifically to FIGS. 4 through 6, bolt assemblies 210 will be described in more detail according to exemplary embodiments of the present subject matter. More specifically, bolt assembly 210 will be described relative to a single box aperture 212 and cabinet aperture 214. However, it should be appreciated that each bolt assembly 210 of shipping assembly 200 may interact with shipping box 202 and washing machine appliance 100 in the same or similar manner as that described below. By contrast, it should be appreciated that each shipping bolt assembly 210 may have slight variations depending on the application or the location of installation.

As illustrated, bolt assembly 210 generally includes a spacer assembly 220 that includes a cabinet spacer 222 and a box spacer 224 that are positioned adjacent to each other for securing wash tub 124 within shipping box 202. More specifically, according to the illustrated embodiment, cabinet spacer 222 generally extends between wash tub 124 and cabinet 102 when in the installed position and box spacer 224 generally extends between cabinet 102 and shipping box 202 when in the installed position.

In this regard, cabinet spacer 222 generally defines a first end 226 and a second end 228 separate along a longitudinal direction 230 (e.g., defined along the length of bolt assembly 210). In general, first end 226 of cabinet spacer 222 is configured for receiving within a boss 232 defined on the back side of wash tub 124. Second end 228 of cabinet spacer 222 is generally positioned adjacent to and against box spacer 224. More specifically, box spacer 224 also extends between a first end 234 and a second end 236 along the longitudinal direction 230. As illustrated, second end 228 of cabinet spacer 222 generally coincides with first end 234 of box spacer 224. Although cabinet spacer 222 and box spacer 224 are illustrated herein as being two separate components, it should be appreciated that according to alternative embodiments, these two components could be rigidly joined or formed as a single unitary piece (e.g., via injection molding, overmolding, or any other suitable manufacturing process).

According to the illustrated embodiment, cabinet spacer 222 and box spacer 224 are colinear and collectively defined a central channel 240. In addition, boss 232, cabinet aperture 214, box aperture 212, and central channel 240 may be generally aligned, e.g., along the longitudinal direction 230, with spacer assembly 220. According to the illustrated embodiment, the longitudinal direction 230 also corresponds to the transverse direction T of washing machine appliance 100. However, it should be appreciated that the alignment of these features may vary while remaining within the scope of the present subject matter.

Bolt assembly 210 further include a shipping bolt 242 that is generally configured for receipt within central channel 240 when bolt assembly 210 is installed for securing wash tub 124. According to an exemplary embodiment, central channel 240 may be broken into a first portion 244 that is defined within cabinet spacer 222 and a second portion 246 that is defined within box spacer 224. As illustrated, the first portion 244 and second portion 246 of central channel 240 are colinear and extend along the longitudinal direction 230. In addition, central channel 240 may be generally aligned with a hole 248 defined within boss 232 of wash tub 124 for receiving shipping bolt 242 when bolt assembly 210 is in an installed position.

In general, central channel 240 defines a channel diameter 250 (e.g., measured perpendicular to the longitudinal direction 230). In order to permit the shipping bolt 242 to recess into shipping box 202 in the installed position (e.g., within central channel 240), channel diameter 250 may be larger in second portion 246 than in first portion 244. Specifically, according to the illustrated embodiment, box spacer 224 may generally define a shoulder 252 at first end 234 of box spacer 224. Channel diameter 250 increases at shoulder 252 such that channel diameter 250 is larger within box spacer 224.

As illustrated, shipping bolt 242 generally includes a threaded shaft 254 and a bolt head 256. In the installed position, threaded shaft 254 may slide freely through first portion 244 of central channel 240, while shoulder 252 prevents bolt head 256 from entering first portion 244. According to an exemplary embodiment, shipping assembly 200 may further include a washer 258 (e.g., such as a flat washer) that is positioned around threaded shaft 254 for achieving secure engagement with shoulder 252 when shipping bolt 242 is in the installed position. Specifically, according to the illustrated embodiment, washer 258 may define a washer diameter that is substantially equivalent to channel diameter 250 within second portion 246 of central channel 240. According to exemplary embodiments, shipping bolt 242 must be fully removed before cabinet spacer 222 and box spacer 224 may be removed from shipping box 202 or may be separated from each other.

Referring now specifically to FIG. 6, first end 226 of cabinet spacer 222 may be seated against an outer surface 260 of cabinet 102 in the installed position. In this manner, the separation between wash tub 124 and cabinet 102 may be fixed as desired, e.g., depending on the length of cabinet spacer 222. In addition, when shipping bolt 242 is tightened down, the spacing between wash tub 124 and cabinet 102 may be rigidly fixed for safe transport. In this manner, forces generated during movement of the washing appliance may be transmitted from the suspended wash tub 124 through bolt assemblies 210 to cabinet 102 instead of through suspension assemblies 129.

Referring still generally to FIGS. 4 through 6, spacer assembly 220 may further include a retention flange 270 that is generally defined at second end 236 of box spacer 224. In this regard, retention flange 270 generally extends radially outward relative to longitudinal direction 230, e.g., to provide engagement with an outer surface 272 of shipping box 202 in order to prevent spacer assembly 220 from falling completely into shipping box 202. In general, cabinet spacer 222 generally defines a cabinet spacer diameter 274 that is smaller than a cabinet aperture diameter 276 of cabinet aperture 214. In this manner, cabinet spacer 222 may slide through cabinet aperture 214 to engage wash tub 124.

By contrast, box spacer 224 defines a box spacer diameter 278 that is larger than cabinet aperture diameter 276 but smaller than a box aperture diameter 280. In this manner, box spacer 224 may slide through box aperture 212 but is prevented from passing through cabinet aperture 214. In addition, retention flange 270 may define a flange diameter 282 that is larger than box aperture diameter 280 to ensure retention of spacer assembly 220 at least partially outside of shipping box 202. Moreover, according to exemplary embodiments, box aperture diameter 280 may be a predetermined amount larger than box spacer diameter 278. For example, according to exemplary embodiments, box aperture diameter 280 is between about 5 millimeters and 20 millimeters larger, between about 10 millimeters and 15 millimeters larger, or about 12 millimeters larger than box spacer diameter 278. In this manner, there is a reduced likelihood that box spacer 224 may transmit forces between shipping box 202 and washing machine appliance 100 through bolt assemblies 210.

Referring now specifically to FIG. 4, box spacer 224 may generally include a cylindrical wall 290 that defines a plurality of longitudinal slits 292 that may further facilitate reduced transmission of forces from shipping box 202 to cabinet 102 and/or wash tub 124. It should be appreciated that bolt assemblies 210 may include additional features for reducing the transmission of forces between shipping box 202 and washing machine appliance 100.

Aspects of the present subject matter are generally directed to shipping bolt assemblies to secure a wash tub or subwasher within a cabinet of a washing machine appliance and to a shipping box. In addition, the shipping bolt assemblies are configured to facilitate clear and easy removal by an installation technician by encouraging the technician to remove the shipping bolt assemblies and the shipping box completely before other installation steps may take place. For example, a long rubber spacer extends from the cabinet and through the shipping box where it is secured by a retention flange. This spacer is easily noticeable by the installer and permits the removal of the shipping bolts from the outside of the shipping box before removing the shipping box from the appliance. The spacer may also include one or more slots to isolate the impact or vibration from shipping. In addition, a gap (e.g., 10 mm) may be defined between the spacer and the aperture through the shipping box to prevent damage during shipping.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A shipping assembly for a washing machine appliance, the washing machine appliance comprising a cabinet defining a cabinet aperture and a wash tub suspended within the cabinet by a suspension assembly, the shipping assembly comprising:

a shipping box defining a box aperture aligned with the cabinet aperture when the cabinet is positioned within the shipping box; and a bolt assembly configured for securing the wash tub within the cabinet when the bolt assembly is in an installed position, the bolt assembly comprising:

a spacer assembly comprising a cabinet spacer that extends between the wash tub and the cabinet and a box spacer that extends between the cabinet and the shipping box, wherein the box spacer has a first end defining a shoulder and a second end defining a retention flange that is seated against an outer surface of the shipping box to prevent the second end from passing into the shipping box; and a shipping bolt comprising a threaded shaft and a bolt head, wherein the threaded shaft passes through the box spacer and the cabinet spacer to secure the spacer assembly to the wash tub in the installed position, and wherein the bolt head is seated against the shoulder of the box spacer in the installed position.

2. The shipping assembly of claim 1, wherein the cabinet spacer and the box spacer of the spacer assembly are colinear and collectively define a central channel for receiving the shipping bolt.

3. The shipping assembly of claim 2, wherein the central channel defines a channel diameter, and wherein the channel diameter increases at the shoulder of the box spacer such that the bolt head may pass through the box spacer up to the shoulder.

4. The shipping assembly of claim 3, further comprising a washer positioned around the threaded shaft of the shipping bolt, the washer having a washer diameter substantially equivalent to the channel diameter within the box spacer.

5. The shipping assembly of claim 2, wherein the first end of the box spacer is seated against an outer surface of the cabinet in the installed position.

6. The shipping assembly of claim 1, wherein cabinet spacer defines a cabinet spacer diameter that is smaller than a cabinet aperture diameter of the cabinet aperture to permit sliding of the cabinet spacer into the cabinet.

7. The shipping assembly of claim 1, wherein a first end of the cabinet spacer contacts the wash tub and is colinear with a boss defined in the wash tub for receiving the threaded shaft of the shipping bolt in the installed position.

8. The shipping assembly of claim 7, wherein the boss, the cabinet aperture, and the box aperture are aligned substantially along a transverse direction.

9. The shipping assembly of claim 1, wherein the box spacer comprises a cylindrical wall defining a plurality of longitudinal slits to reduce transmission of forces from the shipping box to the cabinet or the wash tub.

10. The shipping assembly of claim 9, wherein the cylindrical wall defines a box spacer diameter less than a box aperture diameter of the box aperture to reduce transmission of forces from the shipping box to the cabinet or the wash tub.

11. The shipping assembly of claim 10, wherein the box aperture diameter is between about 5 millimeters and 20 millimeters larger than the box spacer diameter.

12. The shipping assembly of claim 1, wherein cabinet spacer and box spacer are rigidly joined or formed as a unitary piece.

13. The shipping assembly of claim 1, wherein the shipping box defines four box apertures, the cabinet defines four cabinet apertures that correspond to the four box apertures, and the shipping assembly comprises four bolt assemblies.

14. A packaged appliance comprising:

a front load washing machine appliance comprising a cabinet defining a cabinet aperture and a wash tub suspended within the cabinet by a suspension assembly;

a shipping box defining a box aperture aligned with the cabinet aperture when the cabinet is positioned within the shipping box; and a bolt assembly configured for securing the wash tub within the cabinet when the bolt assembly is in an installed position, the bolt assembly comprising:

a spacer assembly comprising a cabinet spacer that extends between the wash tub and the cabinet and a box spacer that extends between the cabinet and the shipping box, wherein the box spacer has a first end defining a shoulder and a second end defining a retention flange that is seated against an outer surface of the shipping box to prevent the second end from passing into the shipping box; and a shipping bolt comprising a threaded shaft and a bolt head, wherein the threaded shaft passes through the box spacer and the cabinet spacer to secure the spacer assembly to the wash tub in the installed position, and wherein the bolt head is seated against the shoulder of the box spacer in the installed position.

15. The packaged appliance of claim 14, wherein the cabinet spacer and the box spacer of the spacer assembly are colinear and collectively define a central channel for receiving the shipping bolt.

16. The packaged appliance of claim 15, wherein the central channel defines a channel diameter, and wherein the channel diameter increases at the shoulder of the box spacer such that the bolt head may pass through the box spacer up to the shoulder.

17. The packaged appliance of claim 14, wherein cabinet spacer defines a cabinet spacer diameter that is smaller than a cabinet aperture diameter of the cabinet aperture to permit sliding of the cabinet spacer into the cabinet.

18. The packaged appliance of claim 14, wherein a first end of the cabinet spacer contacts the wash tub and is colinear with a boss defined in the wash tub for receiving the threaded shaft of the shipping bolt in the installed position.

19. The packaged appliance of claim 14, wherein the box spacer comprises a cylindrical wall defining a plurality of longitudinal slits to reduce transmission of forces from the shipping box to the cabinet or the wash tub.

20. The packaged appliance of claim 19, wherein the cylindrical wall defines a box spacer diameter less than a box aperture diameter of the box aperture to reduce transmission of forces from the shipping box to the cabinet or the wash tub.

* * * * *